US010506835B2

(12) United States Patent
Hines

(10) Patent No.: US 10,506,835 B2
(45) Date of Patent: Dec. 17, 2019

(54) ADJUSTABLE NURSING GARMENT

(71) Applicant: Kathy Denise Hines, Plano, TX (US)

(72) Inventor: Kathy Denise Hines, Plano, TX (US)

( * ) Notice: Subject to any disclaimer, the term of this patent is extended or adjusted under 35 U.S.C. 154(b) by 220 days.

(21) Appl. No.: 15/339,686

(22) Filed: Oct. 31, 2016

(65) Prior Publication Data

US 2018/0116302 A1 May 3, 2018

(51) Int. Cl.
*A41D 1/215* (2018.01)

(52) U.S. Cl.
CPC ..... *A41D 1/215* (2018.01); *A41D 2300/322* (2013.01)

(58) Field of Classification Search
CPC ..... A41D 1/215; A41C 3/04
USPC ..... 2/114, 125, 104; 450/36
See application file for complete search history.

(56) References Cited

U.S. PATENT DOCUMENTS 4,566,136 A * 1/1986 Echols ..... A41D 1/215 2/104
5,182,813 A * 2/1993 Booze ..... A41D 1/215 2/104
5,564,123 A * 10/1996 Grassick ..... A41D 13/1245 2/114
8,323,070 B2 * 12/2012 Abbaszadeh ..... A41C 3/04 450/36
8,840,442 B2 * 9/2014 Linkon ..... A41C 3/144 450/36
9,167,855 B2 * 10/2015 Abbaszadeh ..... A41C 3/04
2010/0095424 A1 * 4/2010 Grgich ..... A41D 13/1236 2/104

(Continued)

*Primary Examiner* — Gloria M Hale

(57) ABSTRACT

This disclosure relates to an article for adjusting a garment. An article is disclosed comprising: a first area of overlapping material comprising at least one first surface and at least one second surface, wherein the at least one first surface overlaps the at least one second surface by a first distance of a first direction along the article, and a second area of overlapping material comprising at least one third surface and at least one fourth surface, wherein the at least one third surface overlaps the at least one fourth surface by a second distance along the article. The at least one first zipper arrangement may comprise: a first pair of tapes with a first respective pair of interdigitating rows of first teeth and a first slider for moving along the first teeth to cause the first teeth to become separated in one first direction of movement of the first slider and to become interdigitated in a first opposite direction of movement of the first slider, wherein the at least one first zipper arrangement being fixed along the at least one first surface in the first area of overlapping material and extending at least partly in the first direction along the article. The at least one second zipper arrangement may comprise: a second pair of tapes with a second respective pair of interdigitating rows of second teeth and a second slider for moving along the second teeth to cause the second teeth to become separated in one second direction of movement of the second slider and to become interdigitating in a second opposite direction of movement of the second slider, wherein the at least one second zipper arrangement being fixed along the at least one second surface in the first area of overlapping material and extending at least partly in the second direction along the article.

20 Claims, 6 Drawing Sheets

(56) References Cited

U.S. PATENT DOCUMENTS

| | | | | |
|---|---|---|---|---|
| 2010/0107300 | A1* | 5/2010 | Yiu | A41D 15/00 2/85 |
| 2013/0232661 | A1* | 9/2013 | Huntley | A41D 1/205 2/104 |
| 2016/0150834 | A1* | 6/2016 | Boele | A41C 3/0035 450/36 |

* cited by examiner

ADJUSTABLE NURSING GARMENT

TECHNICAL FIELD

This disclosure generally relates to a garment that facilitates easy accessibility to a breast of the wearer of the garment when breastfeeding a child.

BACKGROUND

Breastfeeding in public can be a difficult task for mothers because they often times have to raise the garment they are wearing to provide the child with access to their breast. This could result in the mother having to expose more of her body than is necessary, and in most instances contort her body in such way to hold the garment up while feeding the child. Breastfeeding mothers usually have to use one hand to hold the garment in a position to expose the breast, while supporting the child in the other hand. Accordingly, a garment is needed that will allow the wearer of the garment to expose less of their body and also remove the need to use two hands to feed a child.

DETAILED DESCRIPTION

As required, detailed embodiments are disclosed herein. It must be understood that the disclosed embodiments are merely exemplary depictions of various and alternative forms. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

Figure 1:
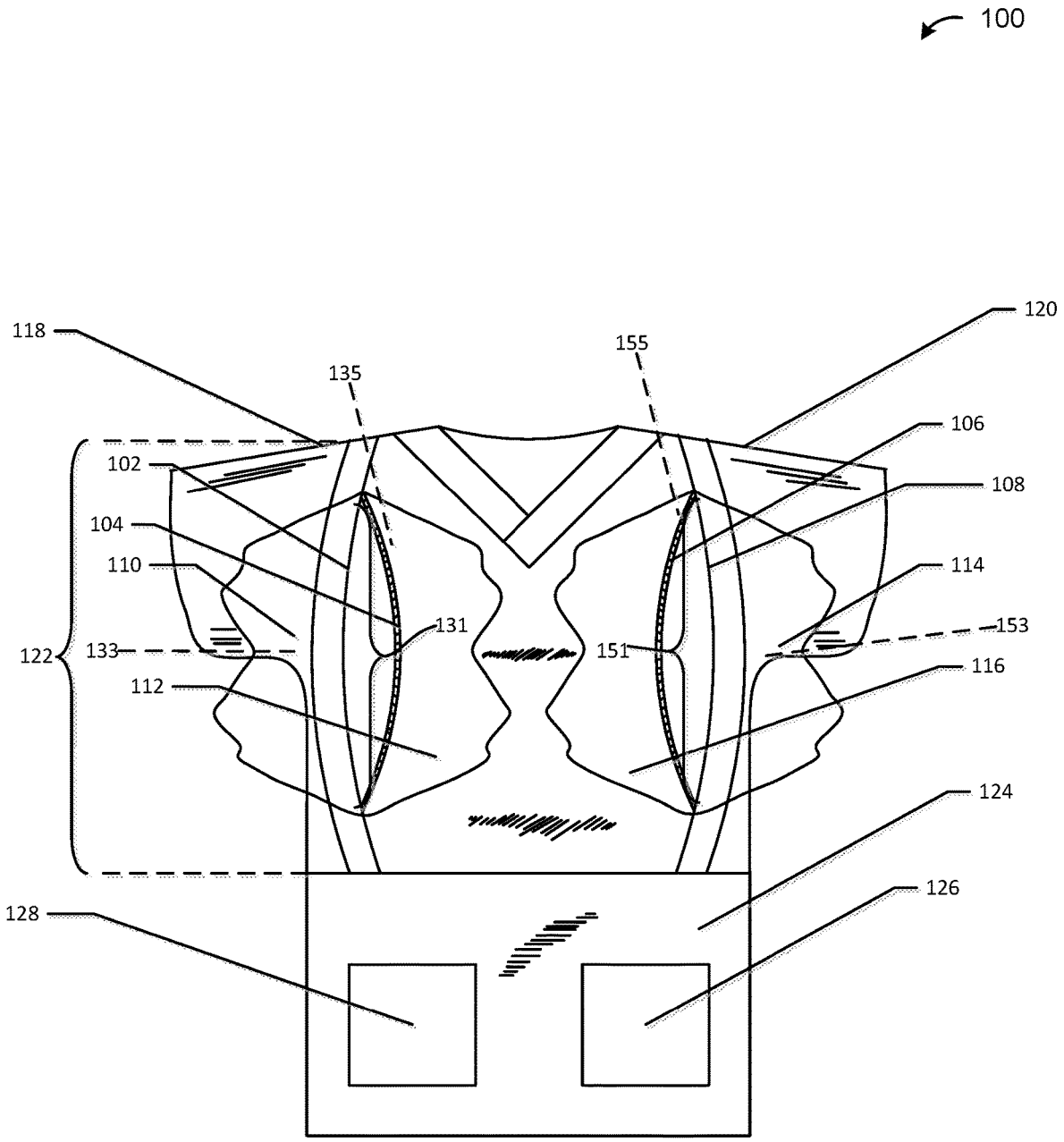
FIG. 1 depicts an exemplary anterior view of a breastfeeding garment in an unfastened position, according to one or more example embodiments of the disclosure.

Referring to FIG. 1 garment 100 comprises an upper portion (e.g., upper portion 122) and a lower portion (e.g., lower portion 124). Upper portion 122 may be comprised of one or more first materials (e.g., silk, wool, polyester, cotton, etc.) and lower portion 124 may be comprised of the one or more first materials, or one or more second materials (e.g., rayon, cashmere, suede). Lower portion 124 may comprise pockets 126 and 128 that may be comprised of the one or more first or second materials, or may be comprised of materials different from the one or more first and second materials.

Upper portion 122 may comprise two sleeves (e.g., sleeve 118 and sleeve 120), a first surface (e.g., surface 102), a second surface (e.g., surface 104), a third surface (e.g., surface 108), and a fourth surface (e.g., surface 106). As depicted in FIG. 1 the first surface is separate from the second surface and the third surface is separate from the fourth surface. When the first surface is separate from the second surface, the first surface and second surface are not fastened (unfastened), and when the third surface is separate from the fourth surface, the third surface and fourth surface are not fastened (unfastened). The first surface may overlap the second surface for a predetermined first distance along a length of upper portion 122, when a first fastener (not shown) is moved in a direction along a length of upper portion 122 to conjoin the first surface and second surface. In some embodiments, the first fastener (e.g., zipper) may be moved along the length (from top to bottom or vice versa) of a first area 131 of upper portion 122. Yet in other embodiments, the first fastener may be moved along the width (from left to right or vice versa) of the first area upper portion 122. For example, the first surface may overlap the second surface over a distance that is a fraction of the length of upper portion 122, when the first fastener is moved in the direction along the length of upper portion 122. For instance, the length of upper portion 122 may be x inches and the predetermined first distance along the length of upper portion 122 may be y inches wherein $y<x$. The first fastener may thus be moved along the predetermined first distance along the length of upper portion 122.

In some embodiments, the second fastener (e.g., zipper) may be moved along the length (from top to bottom or vice versa) of a second area 151 of upper portion 122. The third surface may overlap the fourth surface for a predetermined second distance along a length of upper portion 122. For example, the third surface may overlap the fourth surface over a distance that is a fraction of the length of upper portion 122, when a second fastener (not shown) is moved in the direction along the length of upper portion 122. For instance, the predetermined second distance along the length of upper portion 122 may be z inches wherein z is less than x. The second fastener (e.g., zipper) may thus be moved along the predetermined second distance along the length of upper portion 122. In some embodiments y may be equal to z and in other embodiments y may not be equal to z.

The first fastener may comprise a first pull tab (not shown) affixed to a first slider (not shown), and may be used to fasten and unfasten the first surface area and the second surface area. The second fastener may comprise a second pull tab (not shown) may be affixed to a second slider (not shown), and may be used to fasten and unfasten the third surface area and the fourth surface area.

The first slider may comprise a first and second side separated by a first barrier, wherein the first and second sides may each receive zipper teeth thereby enabling the first slider to move along the zipper teeth to fasten and unfasten the first and second surface areas. The second slider may comprise a first and second side separated by a second barrier, wherein the first and second sides may each receive zipper teeth thereby enabling the second slider to move along the zipper teeth to fasten and unfasten the third and fourth surface areas. The zipper teeth received by the first side of the first slider may be affixed (e.g., sewn and/or glued) to a first piece of material thereby forming a first zipper tape. The zipper teeth received by the second side of the first slider may be affixed to a second piece of material thereby forming a second zipper tape. The first and second zipper tape may be affixed (e.g., sewn and/or glued) to upper portion 122. The zipper teeth received the first side of the second slider may be affixed to a third piece of material thereby forming a third zipper tape. The zipper teeth received by the second side of the second slider may be affixed to a fourth piece of material thereby forming a fourth zipper tape. For example, the first zipper tape may be affixed along the length of surface 102, the second zipper tape may be affixed along the length of surface 104, the third zipper tape may be affixed along the length of surface 108, and the fourth zipper tape may be affixed along the length of surface 106.

The opposite side of the second surface (fifth surface e.g., surface 135) may be internal to garment 100, the opposite side of the first surface (sixth surface e.g., surface 133) may be internal to garment 100, the opposite side of the fourth surface (seventh surface e.g., surface 153) may be internal to garment 100, and the opposite side of the third surface (eighth surface e.g., surface 155) may be internal to garment 100.

In some embodiments, the first zipper tape may be affixed to the first and sixth surfaces and the second zipper tape may be affixed to the second and fifth surfaces respectively. That is, a first backside of the first surface, and a first backside of the sixth surface may be affixed to one another, and a first backside of the first zipper tape may be affixed to a first topside of the first surface and a second backside of the first zipper tape may be affixed to a first topside of the sixth surface. A first backside of the second surface, and a first backside of the fifth surface may be affixed to one another, and a first backside of the second zipper tape may be affixed to a first topside of the second surface and a second backside of the second zipper tape may be affixed to a first topside of the fifth surface. Thus when the first slider is moved in a direction along the length of upper portion 122 to fasten or unfasten the first surface and second surface, the sixth surface and fifth surface may be fastened as well. Because the first surface overlaps the second surface when the first surface is fastened with the second surface, and the sixth surface is the opposite side of the first surface and fifth surface is the opposite side of the second surface, the fifth surface may overlap the sixth surface when the first slider is moved in a direction to fasten the first and second surfaces.

In some embodiments, the third zipper tape may be affixed to the third and eighth surfaces and the fourth zipper tape may be affixed to the fourth and seventh surfaces. That is, a first backside of the third surface, and a first backside of the eighth surface may be affixed to one another, and a first backside of the third zipper tape may be affixed to a first topside of the third surface and a second backside of the third zipper tape may be affixed to a first topside of the eighth surface. A first backside of the fourth surface, and a first backside of the seventh surface may be affixed to one another, and a first backside of the fourth zipper tape may be affixed to a first topside of the fourth surface and a second backside of the fourth zipper tape may be affixed to a first topside of the seventh surface. Thus, when the second slider is moved in a direction along the length of upper portion 122 to fasten or unfasten the third surface and fourth surface, the eighth surface and seventh surface may be fastened as well. Because the third surface overlaps the fourth surface when the third surface is fastened to the fourth surface, and the seventh surface is the opposite side of the fourth surface and the eighth surface is the opposite side of the third surface, the seventh surface may overlap the eighth surface when the second slider is moved in a direction to fasten the third and fourth surfaces.

The topside of the fifth, sixth, seventh, and eighth surfaces may have a cloth insert affixed to them. For example, cloth insert 110 may be affixed to the sixth surface, cloth insert 112, may be affixed to the fifth surface, cloth insert 116 may be affixed to the eight surface, and cloth insert 114 may be affixed to the seventh surface. The cloth insert may comprise any material including but not limited to silk, cotton, polyester, etc. In some embodiments, a cloth insert may be removed from within garment 100 to the outside of garment 100. For example, when first surface and second surface are unfastened cloth inserts 110 and 112 may be removed and placed over the head of a child while a mother is breastfeeding to shield the child's face from unwanted exposure to certain elements (e.g., protection from the sun). In some embodiments, the cloth inserts may pop out by way of one or more splints attached to the cloth insert so that when overlapping surfaces (first and second surfaces and/or third and for surfaces) are being unfastened the one or more splints may deploy the cloth insert from within garment 100 to a position external to garment 100. The one or more splints may be folded upon themselves to form loops of a certain diameter. Elastic energy may be stored in the one more splints while they are in the folded position. The one or more splints may be held in the folded position by one or more straps, and the one or more straps may have a first end and second end affixed to the fifth, sixth, seventh, or eighth surfaces. For example, a first strap may be affixed to the fifth surface, wherein a first end of the first strap may be affixed to a first point on the fifth surface and a second end of the first strap may be affixed to a second point on fifth surface. One or more splints may be held in place against the inside of the garment between the first and second ends of the first strap. The first or second end of the first strap may be affixed using a snap or VELCRO hook or loop. When a wearer of the garment removes the first end or the second end of the first strap, the stored elastic energy in the one or more splints may cause the cloth insert to deploy and cover the head of a nursing child.

Figure 2:
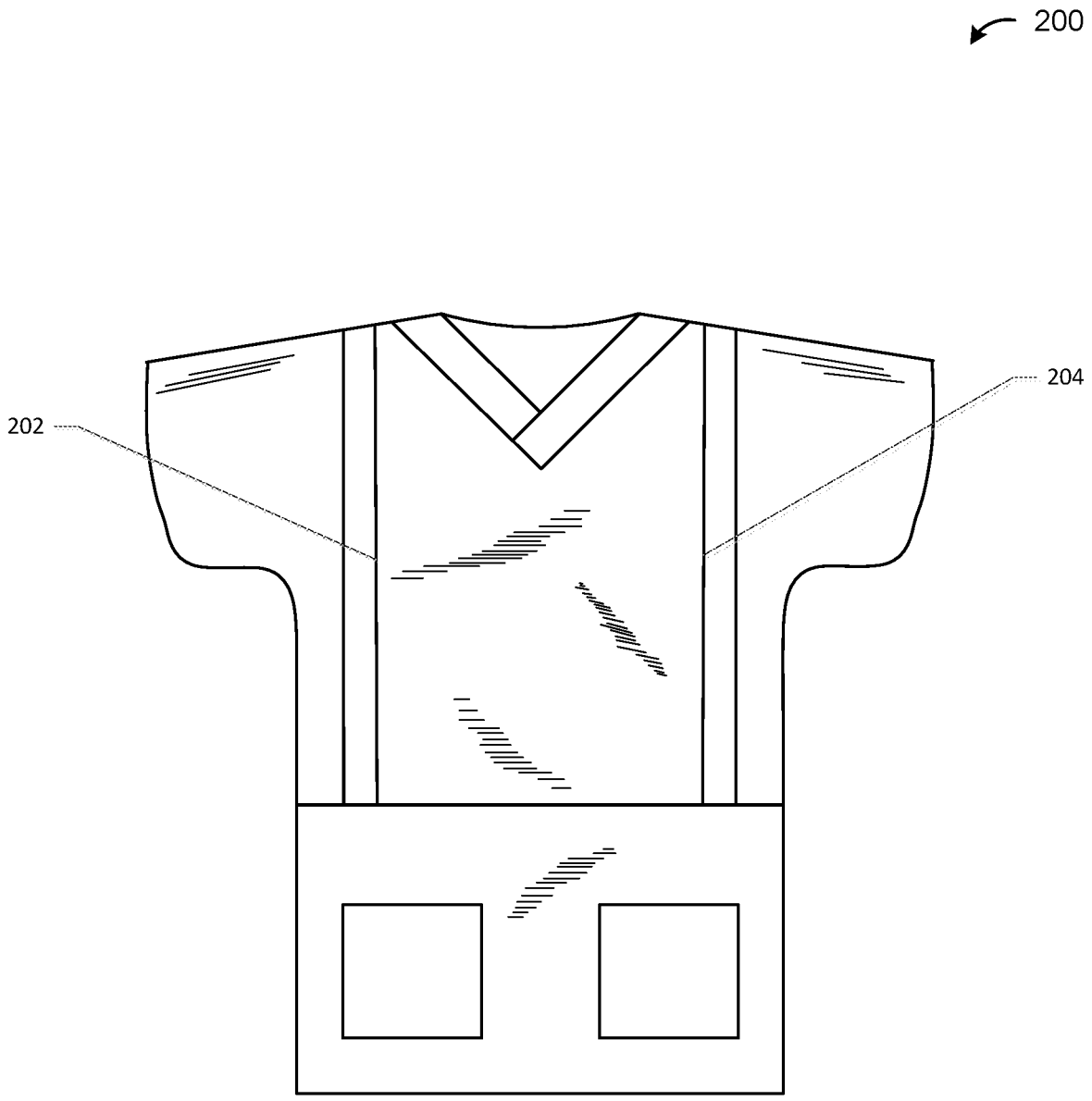
FIG. 2 depicts an exemplary anterior view of a breastfeeding garment in a fastened position, in accordance with one or more example embodiments of the present disclosure.

FIG. 2 depicts an exemplary anterior view of a breastfeeding garment in a fastened position, in accordance with one or more example embodiments of the present disclosure. FIG. 2 illustrates a garment (e.g., garment 200) with the first and second surfaces of FIG. 1 fastened and the third and fourth surfaces of FIG. 1 fastened. Garment 200 may have a similar structure to that of garment 100. Surface 202 may correspond to a fastened first and second surface and surface 204 may correspond to a fastened third and fourth surface.

Figure 3:
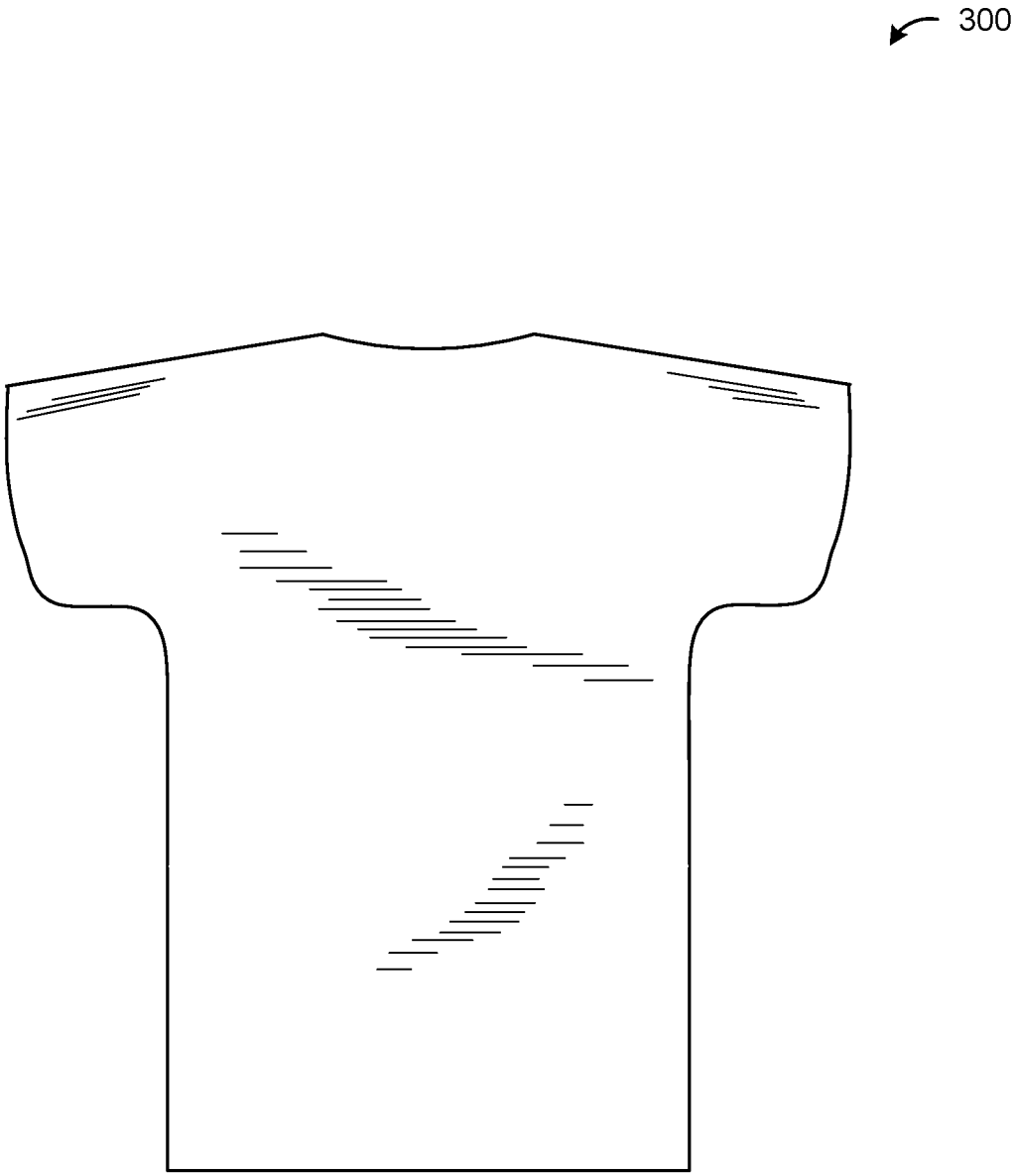
FIG. 3 depicts an exemplary posterior view of a breastfeeding garment, in accordance with one or more example embodiments of the present disclosure.

FIG. 3 depicts an exemplary posterior view of a breastfeeding garment, in accordance with one or more example embodiments of the present disclosure. The posterior of garment 300 may be made of material similar to that of garment 100. In some embodiments, the posterior of garment 300 may be comprised of material that is different than that of garment 100.

Figures 4A, 4B, 4C:
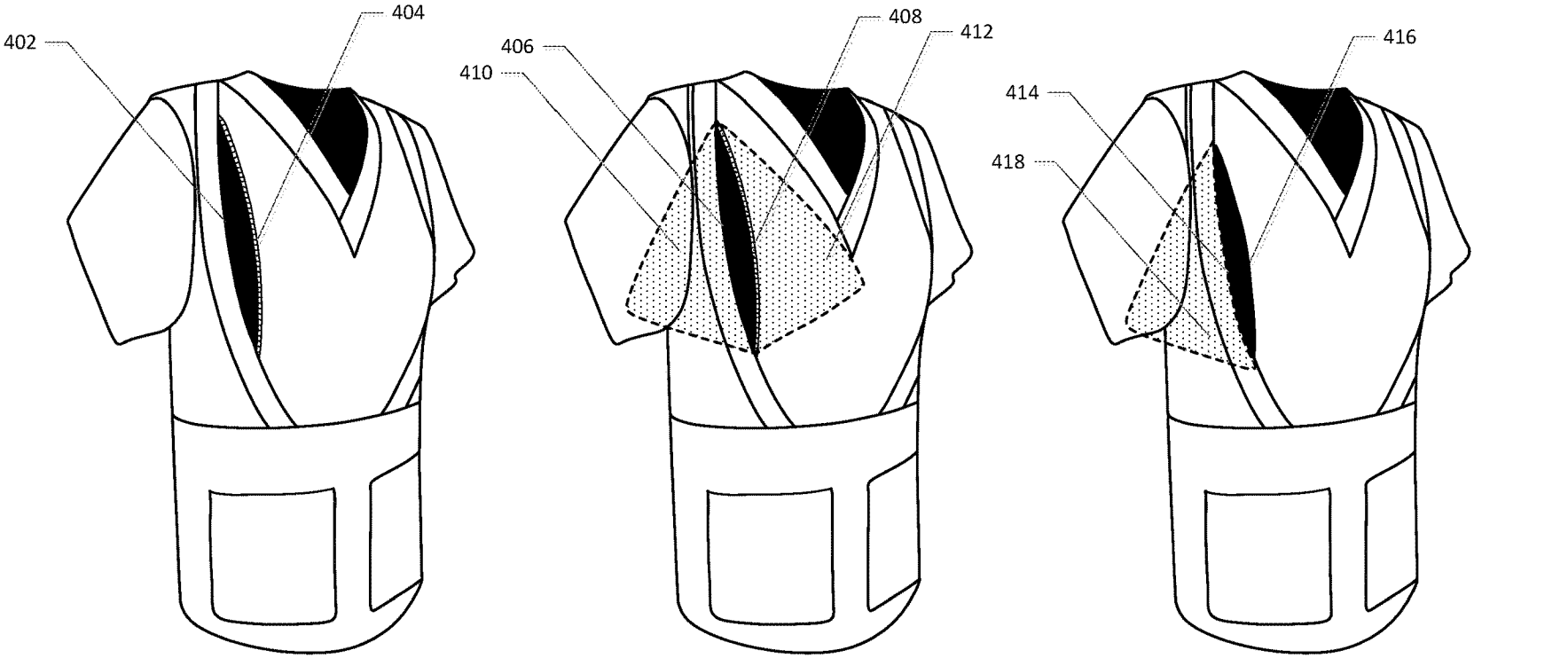
FIG. 4A depicts an exemplary side view of a breastfeeding garment in an unfastened position, in accordance with one or more example embodiments of the present disclosure.
FIG. 4B depicts an exemplary side view of a breastfeeding garment in an unfastened position with cloth inserts, in accordance with one or more example embodiments of the present disclosure.
FIG. 4C depicts an exemplary side view of a breastfeeding garment in an unfastened position with a cloth insert, in accordance with one or more example embodiments of the present disclosure.

FIG. 4A depicts an exemplary side view of a breastfeeding garment in an unfastened position, in accordance with one or more example embodiments of the present disclosure. Surface 402 may be similar to surface 102, surface 404 may be similar to surface 104, and surfaces 402 and 404 are unfastened.

FIG. 4B depicts an exemplary side view of a breastfeeding garment in an unfastened position with cloth inserts, in accordance with one or more example embodiments of the present disclosure. Surface 406 may be similar to surface 402, surface 408 may be similar to surface 404, and surfaces 406 and 408 are unfastened. Cloth inserts 410 and 412 may be similar to cloth inserts 110 and 112 respectively.

FIG. 4C depicts an exemplary side view of a breastfeeding garment in an unfastened position with a cloth insert, in accordance with one or more example embodiments of the present disclosure. In some embodiments there may be only one cloth insert per unfastened garment. For example, unfastened surfaces 414 and 416 may one cloth insert (e.g., cloth insert 418).

Figures 5A, 5B, 5C:
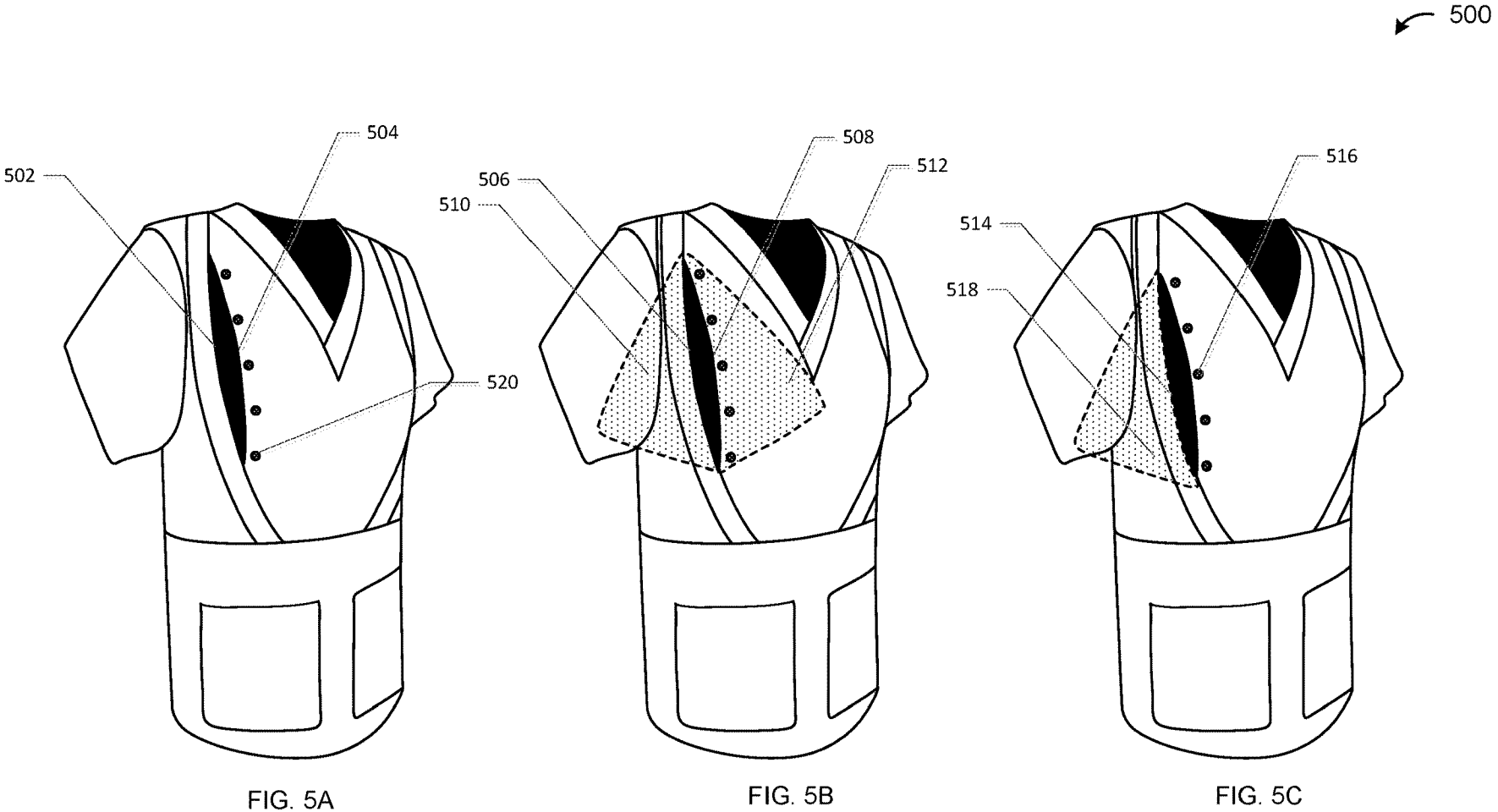
FIG. 5A depicts an exemplary side view of a breastfeeding garment in an unfastened position, in accordance with one or more example embodiments of the present disclosure.
FIG. 5B depicts an exemplary side view of a breastfeeding garment in an unfastened position with cloth inserts, in accordance with one or more example embodiments of the present disclosure.
FIG. 5C depicts an exemplary side view of a breastfeeding garment in an unfastened position with a cloth insert, in accordance with one or more example embodiments of the present disclosure.

FIG. 5A depicts an exemplary side view of a breastfeeding garment in an unfastened position, in accordance with one or more example embodiments of the present disclosure. Surface 502 may be similar to surface 402 and surface 504 may be similar to surface 404, but a different fastener may be used. For example, inserting snap or button fasteners (male fasteners) may be spaced along surface 504 (e.g., fastener 520) and receiving snap or button fasteners (female fasteners) may be spaced along a sixth surface that is opposite surface 502 (not shown). A wearer may secure the breastfeeding garment by inserting the male fasteners into the female fasteners.

FIG. 5B depicts an exemplary side view of a breastfeeding garment in an unfastened position with cloth inserts, in accordance with one or more example embodiments of the present disclosure. Surface 506 may be similar to surface 502, surface 508 may be similar to surface 504, and surfaces 506 and 508 are unfastened. Cloth inserts 510 and 512 may be similar to cloth inserts 410 and 412 respectively.

FIG. 5C depicts an exemplary side view of a breastfeeding garment in an unfastened position with a cloth insert, in accordance with one or more example embodiments of the present disclosure. In some embodiments there may be only one cloth insert per unfastened garment. For example, unfastened surfaces 514 and 516 may one cloth insert (e.g., cloth insert 518).

Figures 6A, 6B, 6C:
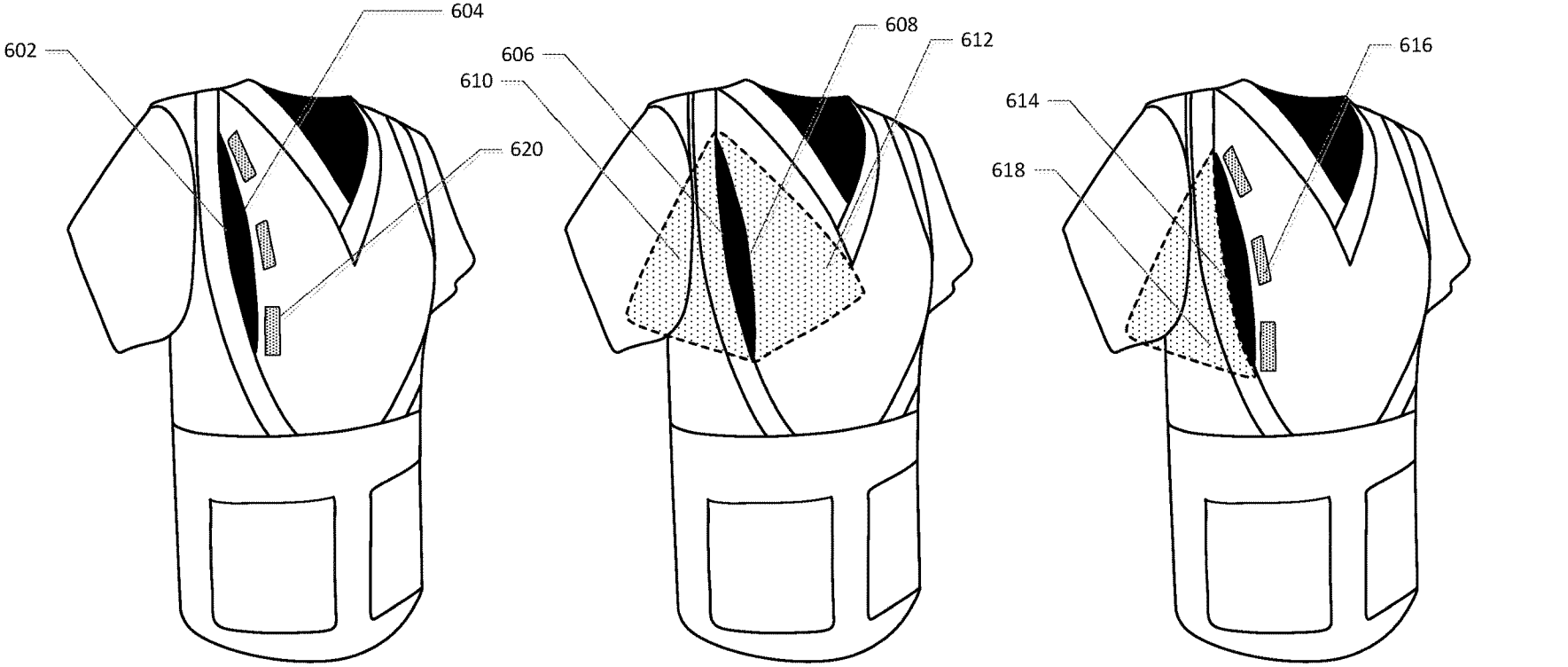
FIG. 6A depicts an exemplary side view of a breastfeeding garment in an unfastened position, in accordance with one or more example embodiments of the present disclosure.
FIG. 6B depicts an exemplary side view of a breastfeeding garment in an unfastened position with cloth inserts, in accordance with one or more example embodiments of the present disclosure.
FIG. 6C depicts an exemplary side view of a breastfeeding garment in an unfastened position with a cloth insert, in accordance with one or more example embodiments of the present disclosure.

FIG. 6A depicts an exemplary side view of a breastfeeding garment in an unfastened position, in accordance with one or more example embodiments of the present disclosure. Surface 602 may be similar to surface 502 and surface 604 may be similar to surface 504, but a different fastener may be used. For example, VELCRO® hooks may be spaced along surface 504 (e.g., fastener hooks 620) and VELCRO® loops may be spaced along a sixth surface that is opposite surface 602 (not shown). A wearer may secure the breastfeeding garment by pressing the VELCRO® hooks against the VELCRO® loops.

FIG. 6B depicts an exemplary side view of a breastfeeding garment in an unfastened position with cloth inserts, in accordance with one or more example embodiments of the present disclosure. Surface 606 may be similar to surface 602, surface 608 may be similar to surface 604, and surfaces 606 and 608 are unfastened. Cloth inserts 610 and 612 may be similar to cloth inserts 510 and 512 respectively.

FIG. 6C depicts an exemplary side view of a breastfeeding garment in an unfastened position with a cloth insert, in accordance with one or more example embodiments of the present disclosure. In some embodiments there may be only one cloth insert per unfastened garment. For example, unfastened surfaces 614 and 616 may one cloth insert (e.g., cloth insert 618).

What is claimed is:

1. A garment comprising:

a first area of overlapping material occupying an upper portion of the garment, the first area of overlapping material comprising at least one first surface and at least one second surface, wherein the at least one first surface overlaps the at least one second surface by a first length of a first direction along the garment, a second area of overlapping material occupying the upper portion of the garment, the second area of overlapping material comprising at least one third surface and at least one fourth surface, wherein the at least one third surface overlaps the at least one fourth surface by a second length along the garment, and the first length is less than a length of the upper portion of the garment and the second length is less than the length of the upper portion of the garment;

at least one first zipper arrangement comprising:

a first pair of tapes with a first respective pair of interdigitating rows of first teeth and a first slider for moving along the first teeth in a vertical direction to cause the first teeth to become separated in one first direction of movement of the first slider in the first area and to become interdigitated in a first opposite direction of movement of the first slider, wherein:

a first tape of the first pair of tapes is affixed to the at least one first surface, a second tape of the first pair of tapes is affixed to the at least one second surface, the at least one first zipper arrangement-extending at least partly along a first vertical length along the garment, and a first region of a person wearing the garment is exposed as the first teeth become separated; and at least one second zipper arrangement comprising:

a second pair of tapes with a second respective pair of interdigitating rows of second teeth and a second slider for moving along the second teeth in a vertical direction to cause the second teeth to become separated in one second direction of movement of the second slider in the second area and to become interdigitated in a second opposite direction of movement of the second slider, wherein:

a first tape of the second pair of tapes is affixed to the at least one third surface, a second tape of the second pair of tapes is affixed to the at least one fourth surface, and the at least one second zipper arrangement extending along a second vertical length along the garment, and a second region of the person wearing the garment is exposed as the second teeth become separated.

2. The garment of claim 1, wherein the first area of overlapping material and the second overlapping material are external to the garment.

3. The garment of claim 1, further comprising a third area of overlapping material and a fourth area of overlapping material, wherein the third area of overlapping material and the fourth area of overlapping material are internal to the garment.

4. The garment of claim 3, wherein the third area of overlapping material comprises at least one fifth and at least one sixth surface, wherein the at least one fifth surface overlaps the at least one sixth surface by the first length of the first direction along the garment.

5. The article of claim 3, wherein the fourth area of overlapping material comprises at least one seventh and at least one eighth surface, wherein the at least one seventh surface overlaps the at least one eighth surface by the second length of the second direction along the garment.

6. The garment of claim 4, wherein a first backside associated with the at least one first surface is affixed to a second backside associated with the at least one sixth surface, and a third backside associated with the at least one second surface is affixed to a fourth backside associated with the at least one fifth surface.

7. The garment of claim 5, wherein a fifth backside associated with the at least one third surface is affixed to a sixth backside associated with the at least one eighth surface, and a seventh backside associated with the at least one fourth surface is affixed to an eighth backside associated with the at least one seventh surface.

8. The garment of claim 6, wherein a first material is affixed to a first front side of the at least one fifth surface, and the first material is internal to the article, and a second material is affixed to a first front side of the at least one sixth surface, and the second material is internal to the article.

9. The garment of claim 8, wherein the first material is configured for removal from a first internal area to a first external area, wherein the first external area is external to the garment, and the second material is configured for removal from a second internal area to a second external area, wherein the second external area is external to the garment.

10. The garment of claim 7, wherein a third material is affixed to a first front side of the at least one seventh surface, and the third material is internal to the garment, and a fourth material is affixed to a first front side of the at least one eighth surface, and the fourth material is internal to the garment.

11. The garment of claim 10, wherein the third material is configured for removal from a third area to a third external area, wherein the third external area is external to the article, and the fourth material is configured for removal from a fourth internal area to a fourth external area, wherein the fourth external area is external to the garment.

12. An garment comprising:

a first area of overlapping material occupying an upper portion of the garment, the first area of overlapping material comprising at least one first surface and at least one second surface, wherein the at least one first surface overlaps the at least one second surface by a first length along a first direction of the garment, a second area of overlapping material occupying the upper portion of the garment, the second area of overlapping material comprising at least one third surface and at least one fourth surface, wherein the at least one third surface overlaps the at least one fourth surface by a second length along a second direction of the garment, and the first length is less than a length of the upper portion of the garment and the second length is less than the length of the upper portion of the garment;

at least one first fastener arrangement, wherein the at least one first fastener arrangement fastens the at least one first surface to the at least one second surface, thereby covering a first region of a person wearing the garment; and at least one second fastener arrangement, wherein the at least one second fastener arrangement fastens the at least one third surface to the at least one fourth surface, thereby covering a second region of the person wearing the garment.

13. The garment of claim 12, wherein the first area of overlapping material and the second overlapping material are external to the garment.

14. The garment of claim 12, further comprising a third area of overlapping material and a fourth area of overlapping material, wherein the third area of overlapping material and the fourth area of overlapping material are internal to the garment.

15. The garment of claim 14, wherein the third area of overlapping material comprises at least one fifth and at least one sixth surface, wherein the at least one fifth surface overlaps the at least one sixth surface by the first distance of the first direction along the garment.

16. The garment of claim 14, wherein the fourth area of overlapping material comprises at least one seventh and at least one eighth surface, wherein the at least one seventh surface overlaps the at least one eighth surface by the second length of the second direction along the garment.

17. The garment of claim 15, wherein a first backside associated with the at least one first surface is affixed to a second backside associated with the at least one sixth surface, and a third backside associated with the at least one second surface is affixed to a fourth backside associated with the at least one fifth surface.

18. The garment of claim 16, wherein a fifth backside associated with the at least one third surface is affixed to a sixth backside associated with the at least one eighth surface, and a seventh backside associated with the at least one fourth surface is affixed to an eighth backside associated with the at least one seventh surface.

19. The garment of claim 17, wherein a first material is affixed to a first front side of the at least one fifth surface, and the first material is internal to the garment, and a second material is affixed to a first front side of the at least one sixth surface, and the second material is internal to the garment.

20. The garment of claim 18, wherein the first material is configured for removal from a first internal area to a first external area, wherein the first external area is external to the garment, and the second material is configured for removal from a second internal area to a second external area, wherein the second external area is external to the garment.

* * * * *